US007458134B2

(12) United States Patent
Shiue

(10) Patent No.: US 7,458,134 B2
(45) Date of Patent: Dec. 2, 2008

(54) CONSTRICTION ASSEMBLY

(75) Inventor: Chih-Cheng Shiue, Escondido, CA (US)

(73) Assignee: QDS Injection Molding LLC, Escondito, CA (US)

( * ) Notice: Subject to any disclaimer, the term of this patent is extended or adjusted under 35 U.S.C. 154(b) by 0 days.

(21) Appl. No.: 10/915,546

(22) Filed: Aug. 11, 2004

(65) Prior Publication Data

US 2006/0032027 A1 Feb. 16, 2006

(51) Int. Cl.
*A44B 11/26* (2006.01)

(52) U.S. Cl. ..... 24/68 E; 24/170; 24/193

(58) Field of Classification Search ..... 2/418, 2/452, 195.2–195.4; 24/DIG. 48, 68 R, 68 J, 24/68 SK, 68 A, 68 E, 170, 191, 193
See application file for complete search history.

(56) References Cited

U.S. PATENT DOCUMENTS 4,607,398 A * 8/1986 Faulconer ..... 2/452
5,467,508 A * 11/1995 Feng ..... 24/68 SK
6,185,794 B1 * 2/2001 Maggi ..... 24/170
6,871,386 B2 * 3/2005 Chen-Lieh ..... 24/168

* cited by examiner

*Primary Examiner*—James R. Brittain
(74) *Attorney, Agent, or Firm*—Troxell Law Office, PLLC

(57) ABSTRACT

A constriction assembly that has a regulator on two ends of head bands and includes a casing seat, the regulator and a pad. By pressing protruding buttons of the regulator support arms formed on both sides of the buttons are displaced and driving turning bodies to disengage the chuck groves from the projection pieces of the band so that the band can reach a loosened state. In contrary, the band can be constricted by pulling the ends of the band while the protruding buttons are free of pressure.

7 Claims, 4 Drawing Sheets

CONSTRICTION ASSEMBLY

FIELD OF THE INVENTION

The present invention relates to a constriction assembly more particularly, to a device used for a face or eye mask, as well as a swimming, sport or work mask, etc. for adjusting a degree of tightness so as to control the tightness of a headband.

BACKGROUND OF THE INVENTION

As shown in FIG. 1, a traditional configuration of a mask includes an eye patch portion A that has parts covering a nose and can cover a mouth, buckles B are located on opposing sides of the eye patch portion A and a band C is connected to the two buckles B at ends D thereof. By virtue of the buckles B, the band C can be adjusted to fit a head of a user. The said mask may further include various bands to be adjusted on an object to be constricted.

For example, the masks disclosed in U.S. Pat. Nos. 6,381,761 and 6,460,995B1 have buckles located on opposing sides of the mask for adjusting a degree of tightness of the headbands.

The buckles are located on the sides of eye patch portion and are difficult to operate simultaneously, which results in displacement of the eye patch portion and an imbalance fo pressure often occurs when the band is adjusted. Therefore, improving the operation and the configuration of the buckles is an important task.

SUMMARY OF THE INVENTION

It is a primary object of the present invention to provide a constriction assembly for a mask designee to be located on a back of a head of a user, so as to have the band provided on both sides of mask without the need of mounting buckles on the mask.

In order to achieve the above object the constriction assembly of the invention includes the following:

A casing seat with a concave-shaped and having two side walls, an regulator located in an interior of the casing seat, and a base connected to a pad. The side walls having two opposite bores at the middle thereof for receiving protruding buttons of the regulator and two pairs of bores respectively at opposite ends for mounting tenons of a turning body, and on an interior of the side walls is a round stick located near the turning body on which two ends of a band are connected.

A regulator having protruding buttons protruding outwardly from opposite sides, wherein both sides of each protruding button are connected to turning bodies. Each of the turning bodies has a pair of tenons at two transverse sides and a chuck groove at an outside thereof.

A pad underlying the casing seat.

The two band having ends mounting on the round sticks in the casing seat and the said ends provided with projection pieces.

A constriction configuration can be obtained where the ends of the two bands are adjustable and can be pulled to constrict an object, when a pressure is applied to the protruding buttons making the support arms move, thereby the turning bodies are drawn by the support arms and slightly turned the chuck grooves displace form the bands allowing the bands to be adjusted.

The profile of the casing seat is an arc shape.

The pad is made of soft material.

The present invention assembly includes a casing seat that has a function protecting the inside of the regulator from external forces or substances. The profile of the casing seat may be a flat smooth arc shape that not only reduces resistance but also gives its aesthetic feeling.

The present invention provides one pad between the assembly and head, wherein this pad may be made of more soft material and by which the pressure position on the head can be dispersed.

The regulator in the assembly can be made of material that is deformable and flexible, such as POM, PVC, Silicone and Nylon.

The adjusting position of the present constriction assembly is shaped apart from both sides of face mask. Therefore, the constriction assembly does not influence the mask by the pull force exerted via the band and thus pressure on the face by the mask will be balanced.

The operation of the present assembly can be performed with a single hand by two fingers' pressing on the button in the opposite direction and thus making the constriction assembly into loosen state, and exerting pull force on the two ends of the right and left bands can equably obtain the goal of constriction.

DETAILED DESCRIPTION OF THE PREFERRED EMBODIMENTS

Figure 1:
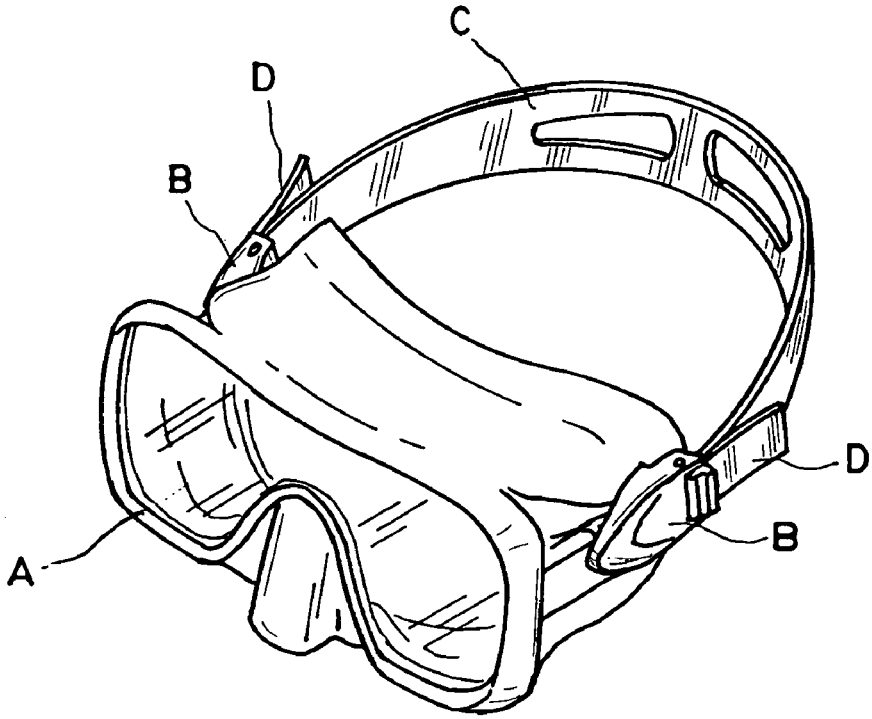
FIG. 1 (PRIOR ART)
FIG. 1 is a perspective view showing a swimming mask in the prior art.
Figure 2:
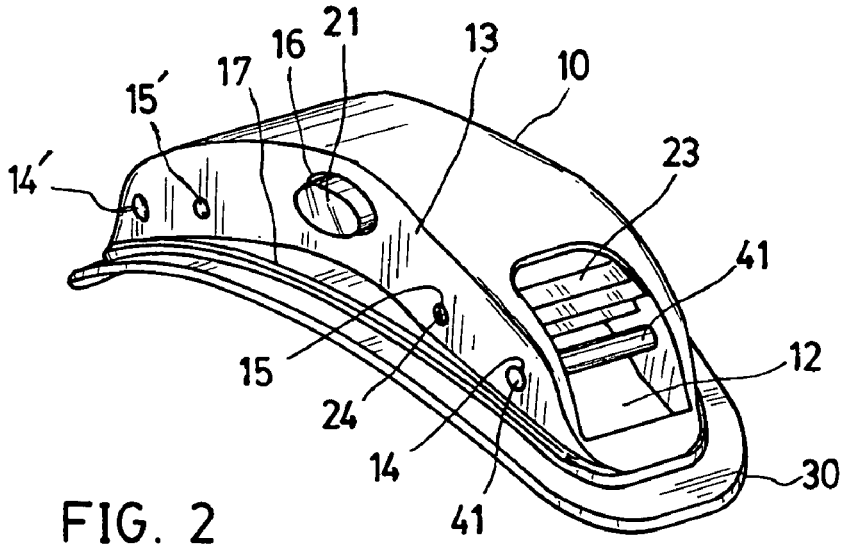
FIG. 2 is a perspective view showing a adjust assemble for band of the present invention.
Figure 3:
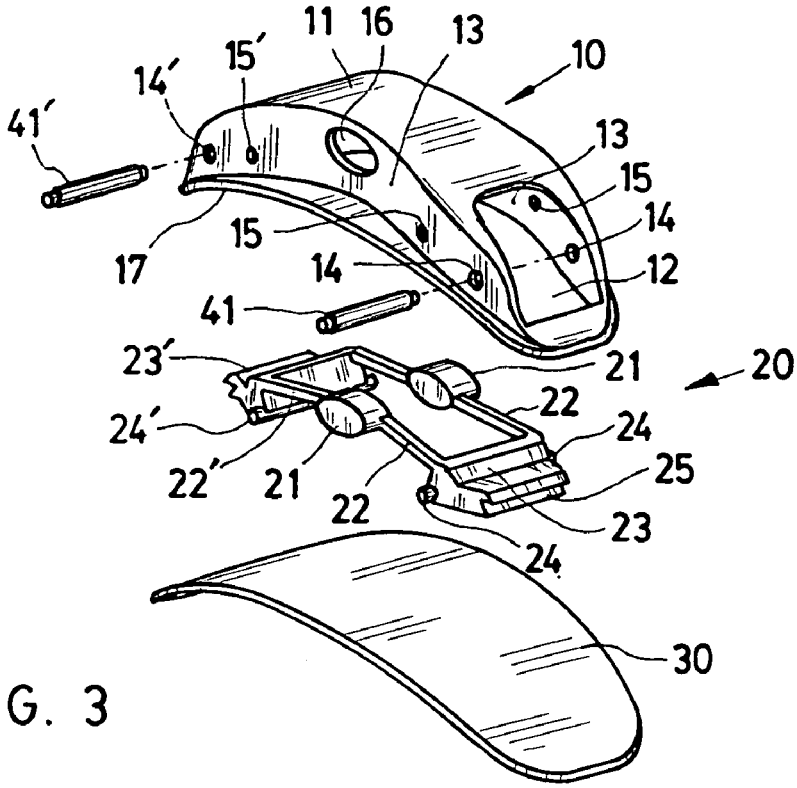
FIG. 3 is exploded perspective view depicting a adjust assemble for band of the present invention.

In FIGS. 1, 2, 3 and 4, the present invention includes a casing seat 10, a regulator 20 and at least a pad 30 and two bands 40.

The casing seat 10 is primarily used to house the regulator 20 as well as fasten the bands 40, and the base of the casing seat 10 is connected to the pad 30.

The casing seat 10 includes a casing body 11 that has a long receptacle profile and the casing body 11 can be provided with openings 12 at the right and left ends thereof as well as side walls 13 on a front and back thereof. The side walls 13 are provided with two pairs of bores 14, 14' and another group bores 15, 15' at corresponding positions thereof, respectively, a well as opposite bores 16 formed on the middle thereof. There is provided a connection seat 17 at a bottom of the casing body 11 to which the pad 30 is connected.

The regulator 20 includes a group opposite protruding buttons 21, support arms 22, 22' at the both sides of each button 21 and turning bodies 23, 23' provided at the two outsides of the support arms 22, 22'. A pair of general co-axes tenons 24, 24' are formed on two sides of the turning bodies 23, 23' that are provided with chuck grooves 25, 25' at the peripheries thereof.

The buttons 21 are received in the bores 16 while the tenons mounting in the bore 15, 15' such that the regulator can be installed into the casing seat 10.

The pad 30 made of soft material is secured under the connection seat 17 so as to be located between the present assembly and the object to be constricted thereby making the present invention comfortable to use.

A pair of round sticks 41, 41' are located in the two-pair bores 14, 14' to allow the band 40 passing through. The band 40 is to pass around the round sticks 41, 41'; well-know member and is made of soft material that can have considerable elasticity and pliability.

Figure 4:
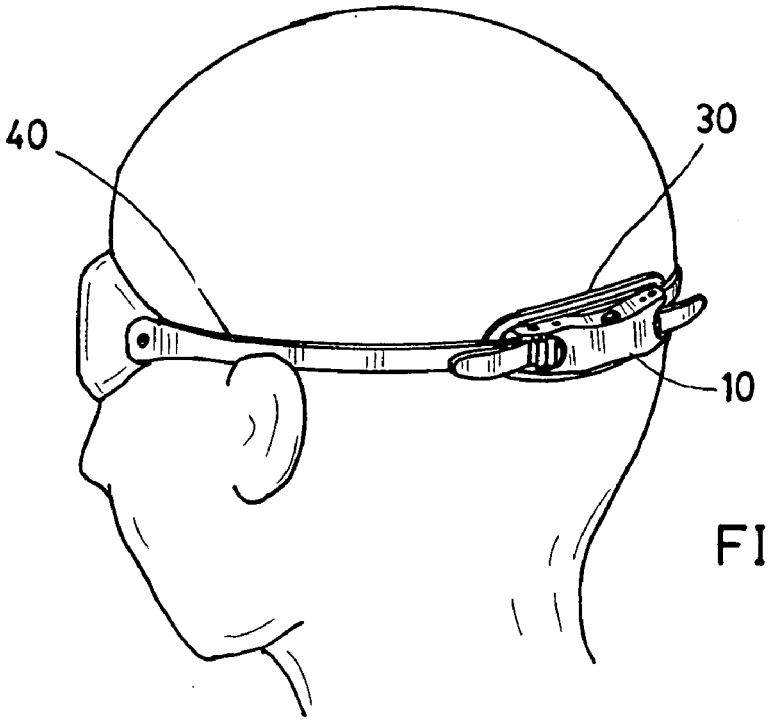
FIG. 4 is a schematic view of the use state of the present invention.

In FIG. 4, the present invention assembly is used to serve a device on a band of a user.

Figure 5:
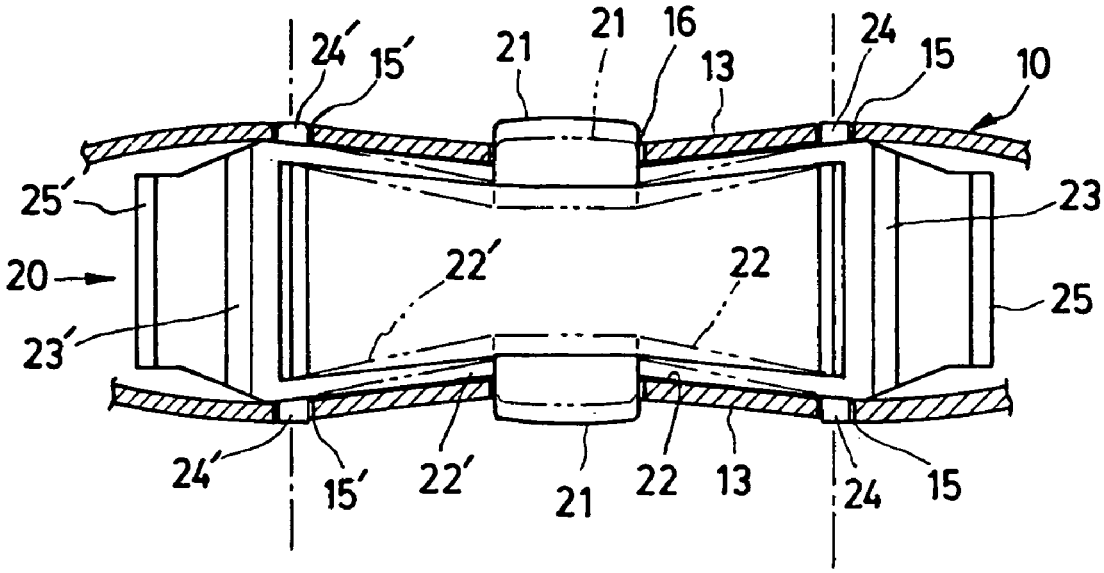
FIG. 5 is an elevational view of the regulator in the schematic view of deformation state.
Figure 6:
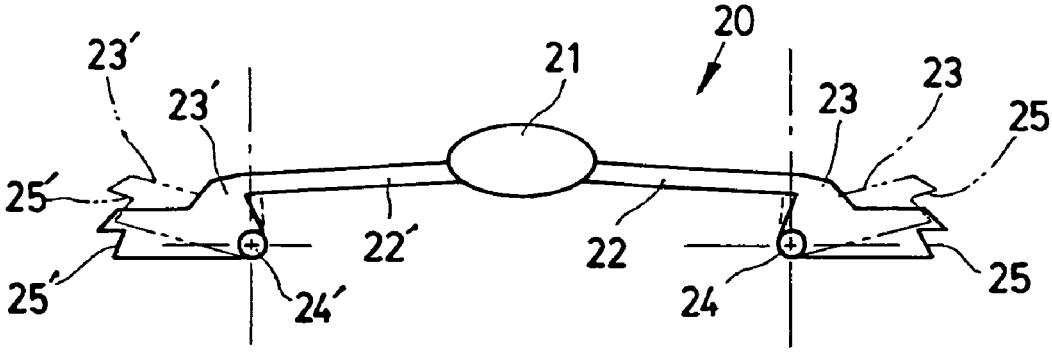
FIG. 6 is a side view of the regulator in the schematic view of deformation state.

FIGS. 5 and 6 show the deformation states of the regulator 20 in the present invention of the assembly with the protruding buttons 21 of the regulator under pressure, and FIG. 5 further involves partial members of the casing seat 10. The imaginary lines in the views indicate the deformation state with displacement. When the protruding buttons 21 are forced inwardly, the support arms 22, 22' also move inwardly and under this condition the turning bodies 23, 23' are pulled by the support arms relative to the tenons 24, 24' as axes by reason that the tenons 24, 24' are mounted in the bores 15, 15' of the upward walls 13, and the turning bodies being in slight rolling state. Therefore to make the chuck grooves 25, 25' displace is thus to make the band disengage form the control of the grooves 25, 25'.

Figure 7:
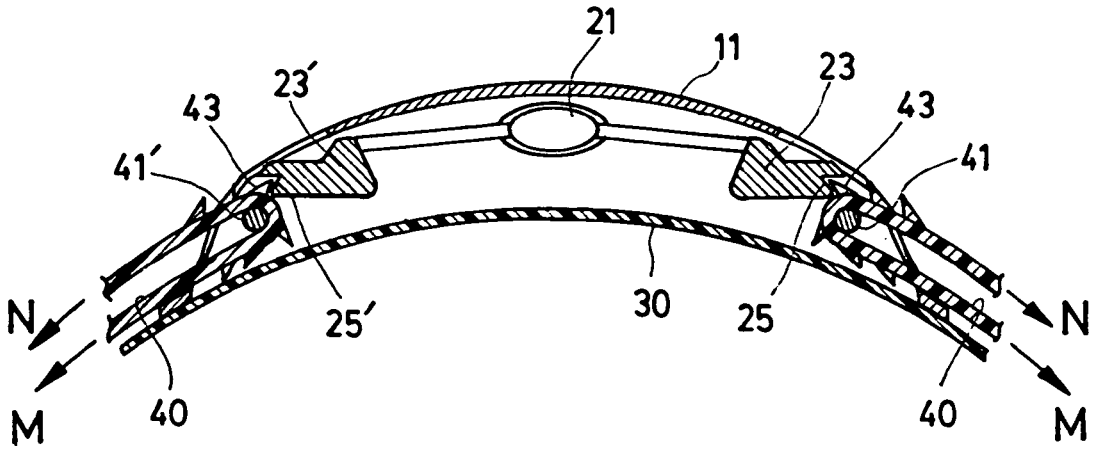
FIG. 7 is a sectional view (1) showing the adjust assembly for band of the present invention.
Figure 8:
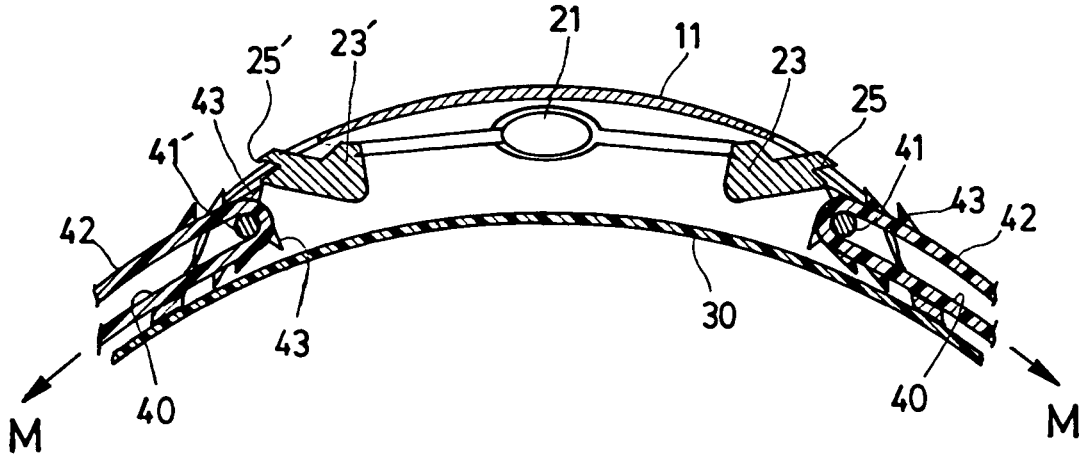
FIG. 8 is a sectional view (2) showing the adjust assembly for band of the present invention.

In FIGS. 7 and 8, the bands 40 are coiled on the round sticks 41, 41' and the two ends 42 of the band 40 are provided with some projection pieces 43. When the protruding buttons 21 are free of pressure, as shown in FIG. 7, the projection pieces 43 that are a well known structure provided on the adjacent of band end are engaged and locked by the chuck grooves 25, 25' and then the band 40 can not move toward the direction of M in which the displacement can bring the band 40 to loosen state. However, since the band 40 formed with soft material, the movement that may result into a constriction state from end portion 42 to the direction of N is allowable, i.e., the end portion 42 can be pulled to increase the tightness of band under the circumstances. When the buttons 21 of the regulator 20 are under pressure, as seen in FIG. 8, the turning bodies 23, 23' make rotary movement and the projection pieces 43 are not under the control of the chuck grooves 25, 25' anymore such that the constricted bands 40 advances automatically toward the direction of M moving to the loosen state. IN other words, when the protruding buttons 21 are pressed for a short time, the band 40 can be slightly adjusted to loosen the degree of tightness; if the buttons are held a little longer, the bands 40 can reach to absolute loosen state.

While there has been illustrated one of preferable embodiments of the present invention, numerous changes and modifications occurring by those skilled in the art will not depart from the scope fo the present invention.

The invention claimed is:

1. A constriction assembly comprising:

a) a casing seat having:

i) two sides;

ii) a hollow interior;

iii) an opening on each of two opposing ends thereof communicating with the hollow interior;

iv) four first bores, one of the four first bores is located on each of two opposing ends of each of the two sides;

v) two center bores, one of the two center bores is located through a middle section of each of the two sides; and vi) four second bores, one of the four second bores is located between the center bore and each of the four first bores;

b) a regulator having:

i) a first button inserted through a first of the two center bores;

ii) two first support arms, one of the two first support arms being connected at a first end thereof to each of two opposing sides of the first button;

iii) a second button inserted through a second of the two center bores, the first button and the second button being movable between locked and depressed positions;

iv) two second support arms, one of the two second support arms being connected at a first end thereof to each of two opposing sides of the second button; and v) two turning bodies, a second end of one of the two first support arms being connected to a first end of each of the two turning bodies, a second end of one of the two second support arms being connected to a second end of each of the two turning bodies, each of the two turning bodies having two tenons and a chuck groove, two tenons of one of the two turning bodies being inserted into two of the four second bores located on each of the two opposing ends of the casing seat;

c) a pad connected to a connection seat located on a bottom of the casing seat;

d) two round sticks, opposing ends of one of the two round sticks is inserted into two of the four first bores located on each of the two opposing ends of the casing seat; and e) two bands, one of the two band is threaded around each of the two round sticks, wherein, when the first button and the second button are in the locked position, the chuck groove of one of the two turning bodies locking each of the two bands in a selected position and preventing the two bands from bring loosened, and, when the first button and the second button are in the depressed position, the chuck groove of one of the two turning bodies is spaced apart from each of the two bands and the two bands are freely movable around the two round sticks.

2. The constriction assembly according to claim 1, wherein each of the two bands has a plurality of projection pieces.

3. The constriction assembly according to claim 1, wherein the connection seat has a curved cross section.

4. The constriction assembly according to claim 1, wherein each of the two sides has a curved cross section.

5. The constriction assembly according to claim 1, wherein the pad is made of a soft material.

6. The constriction assembly according to claim 1, wherein, when the first button and the second button are in the depressed position, the first button pressing the two first support arms inwardly, and the second button pressing the two second support arms inwardly.

7. The constriction assembly according to claim 1, wherein, when the first button and the second button are in the locked position, the two bands are adjustable to increase a constriction force.

* * * * *